US007073408B2

(12) United States Patent
Kim

(10) Patent No.: US 7,073,408 B2
(45) Date of Patent: Jul. 11, 2006

(54) ELECTRONIC ACCELERATOR PEDAL SYSTEM WITH A FOOT PRESSURE-ADJUSTING FUNCTION

(75) Inventor: Duck-Ki Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 434 days.

(21) Appl. No.: 10/443,945

(22) Filed: May 21, 2003

(65) Prior Publication Data

US 2004/0065167 A1 Apr. 8, 2004

(30) Foreign Application Priority Data

Oct. 4, 2002 (KR) ..... 10-2002-0060654

(51) Int. Cl.
*G05G 1/14* (2006.01)

(52) U.S. Cl. ..... 74/513

(58) Field of Classification Search ..... 74/512–514, 74/560

See application file for complete search history.

(56) References Cited

U.S. PATENT DOCUMENTS

| | | | | |
|---|---|---|---|---|
| 6,276,229 | B1 | 8/2001 | Gohring et al. | 74/513 |
| 6,289,762 | B1 * | 9/2001 | Silva | 74/513 |
| 6,289,763 | B1 | 9/2001 | Rixon et al. | 74/514 |
| 6,295,890 | B1 | 10/2001 | Rixon et al. | 74/512 |
| 6,298,748 | B1 | 10/2001 | Rixon et al. | 74/512 |
| 6,626,061 | B1 * | 9/2003 | Sakamoto et al. | 74/512 |
| 6,658,963 | B1 * | 12/2003 | Yaddehige | 74/512 |
| 6,745,642 | B1 * | 6/2004 | Kumamoto et al. | 74/512 |
| 6,758,114 | B1 * | 7/2004 | Sundaresan et al. | 74/512 |
| 6,834,564 | B1 * | 12/2004 | Huesges et al. | 74/513 |

* cited by examiner

*Primary Examiner*—Chong H. Kim
(74) *Attorney, Agent, or Firm*—Morgan Lewis & Bockius LLP

(57) ABSTRACT

An electronic accelerator pedal system with a foot pressure-adjusting function. The foot pressure is variably adjusted with respect to the pedal arm stroke during the depressing and releasing of the accelerator pedal to improve the accelerator manipulation sensation. A foot pressure-adjusting means is installed on the pedal arm that causes a foot pressure to be varied in accordance with the pivoting direction of the pedal arm.

2 Claims, 6 Drawing Sheets

ELECTRONIC ACCELERATOR PEDAL SYSTEM WITH A FOOT PRESSURE-ADJUSTING FUNCTION

FIELD OF THE INVENTION

Generally, the present invention relates to an electronic accelerator pedal system with a foot pressure-adjusting function. More particularly the electronic accelerator pedal incorporates a system that provides variable resistance with respect to the stroke of the pedal arm during depression and release of the accelerator pedal.

BACKGROUND OF THE INVENTION

Typically, an accelerator manipulation device is either a mechanical device or an electronic device. The mechanical accelerator pedal system includes a pedal that is pivotally mounted on the driver's side floorboard, a throttle mechanism installed in the intra-engine suction system, and a cable connecting the accelerator pedal to the throttle mechanism that transmits a manipulation force. An electronic accelerator pedal system includes an accelerator pedal pivotally mounted on the driver's side floorboard and a detection sensor installed on the accelerator pedal that detects the position of the accelerator pedal on a real time basis.

A conventional mechanical accelerator pedal system generates a foot pressure hysteresis effect, and thus, no special problem occurs in the foot pressure tuning of the accelerator pedal. The foot pressure hysteresis effect refers to a phenomenon where a driver's passive reaction force (about 2 kgf), caused from friction of the cable during the releasing of the pedal, is small compared to the driver's passive reaction force (about 3.5~4.5 kgf) during the depressing of the pedal. In contrast, in a conventional electronic accelerator pedal system the driver's passive reaction force, during depression, steady state, and release of the pedal, is determined only by the inherent elasticity of a return spring. The quantitative degree of the reactive force of the return spring is determined on the basis of depression of the pedal for acceleration. However, a drawback of this system is that there is no resistance in the system which counteracts the spring's reactive force while a driver holds a steady accelerator position. As a result, the driver's ankle is subjected to fatigue after repetitive depressions of the pedal. Consequently, the manipulability of the accelerator is aggravated.

SUMMARY OF THE INVENTION

The present invention provides an electronic accelerator pedal system with a foot pressure-adjusting function. The pivoting of the pedal is electrically detected to determine the degree of acceleration requested by the driver. The reactive foot pressure felt by the driver is made variable during the depressing and releasing of the pedal. Therefore, the driver's fatigue during frequent manipulation of the pedal is reduced, thereby improving the manipulability of the accelerator.

In accordance with an embodiment of the present invention, the electronic accelerator pedal system with a foot pressure-adjusting function comprises a pedal arm pivotally installed within a car interior. Additionally, a detection sensor for detecting the degree of pedal arm movement and a foot pressure-adjusting means is installed on the pedal arm for varying the foot pressure in accordance with the pivoting direction of the pedal arm. Furthermore, a contact member for contacting the foot pressure-adjusting means during the pivoting of the pedal arm is included.

In an alternative embodiment the electronic pedal system comprises a pedal arm pivotally coupled with a structural body and a detector sensor for detecting an amount of movement of the pedal arm. An elastic member generates a return force against movement of the pedal arm. Also included is a pressure-adjusting system that comprises a first friction member coupled to the pedal arm and a second friction member coupled to the structural body. The second friction member is configured and dimensioned to contact the first friction member and the contact between the friction members opposes movement of the pedal arm.

BRIEF DESCRIPTION OF THE DRAWINGS

For a fuller understanding of the nature and objects of the present invention, reference should be made to the following detailed description taken in conjunction with the accompanying drawings in which.

DETAILED DESCRIPTION OF THE PREFERRED EMBODIMENTS

Figure 1:
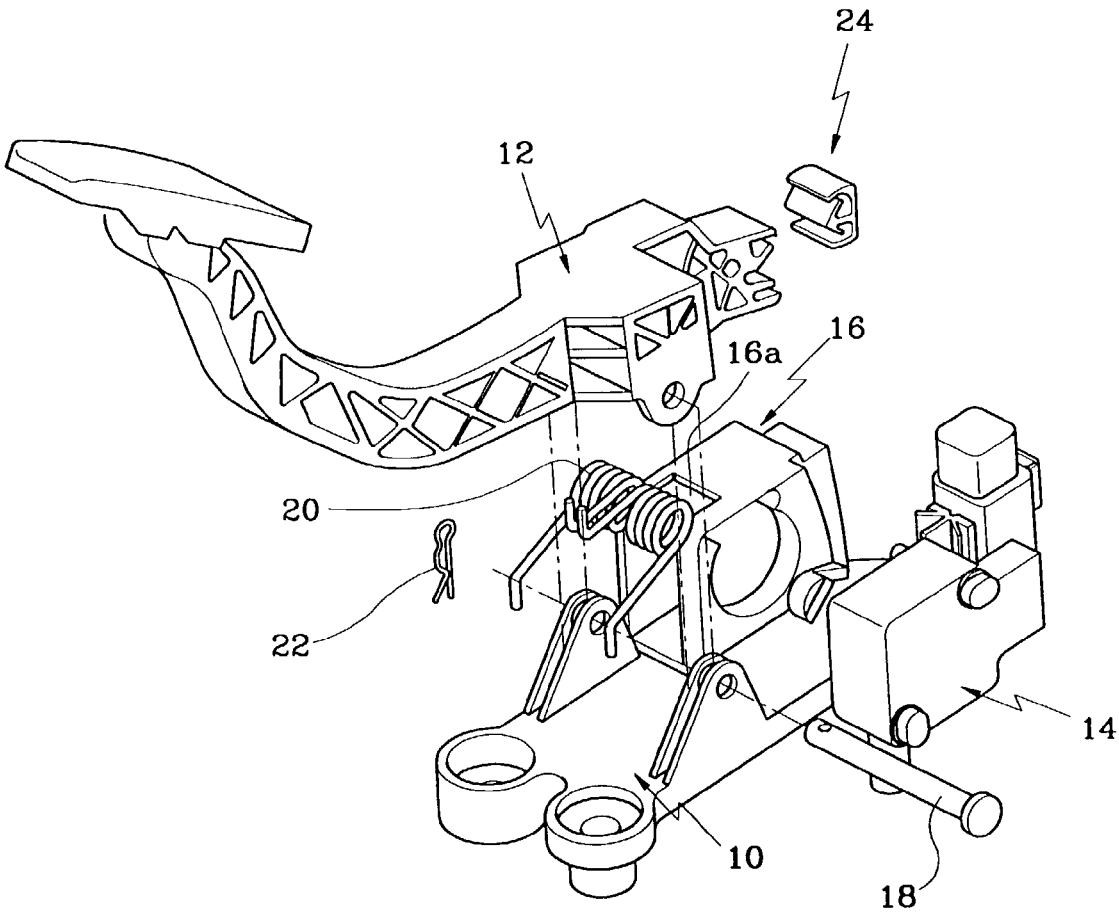
FIG. 1 is an exploded perspective view of an embodiment of the electronic accelerator pedal system of the present, invention with a foot pressure-adjusting function.
Figure 2:
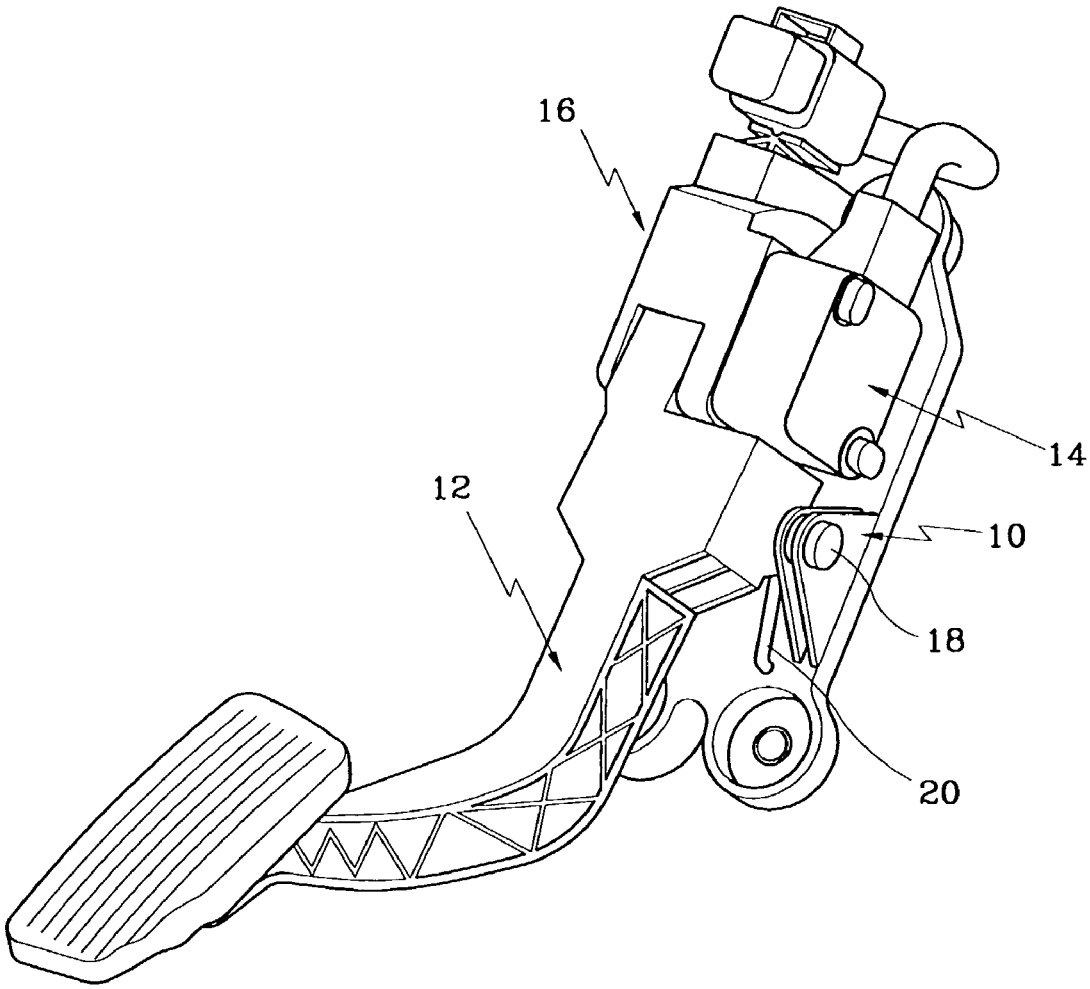
FIG. 2 is a perspective view showing the assembled state of the electronic accelerator pedal system of FIG. 1.

As shown in FIGS. 1 and 2, the electronic accelerator pedal system with a foot pressure-adjusting function according to the present invention includes a housing 10 secured to a lower panel within a car's interior. A pedal arm 12 is pivotally installed on the housing 10 and a detection sensor 14, such as a potentiometer, is secured on one side of the housing 10. The detection sensor 14 electrically detects the degree the pedal arm 12 is pivoted during use. A foot pressure-adjusting means is installed on the pedal arm 12 for varying the foot pressure in accordance with the pivoting direction of the pedal arm 12. Also, a contact member 16 is formed on the leading end of the housing 10 for contacting the foot pressure-adjusting means during the pivoting of the pedal arm.

A pivot-supporting fastening pin 18 is coupled to the housing 10 and the pedal arm 12 provide pivot of the pedal arm 12 with respect to the housing 10. A pair of torsion springs 20 are fitted to the fastening pin 18 to elastically pivot the pedal arm 12 in relation to the housing 10. On one end of the pivot-supporting fastening pin 18, there is a securing pin 22 for preventing the fastening pin 18 from becoming separated from the housing 10 and the pedal arm 12.

Figure 3:
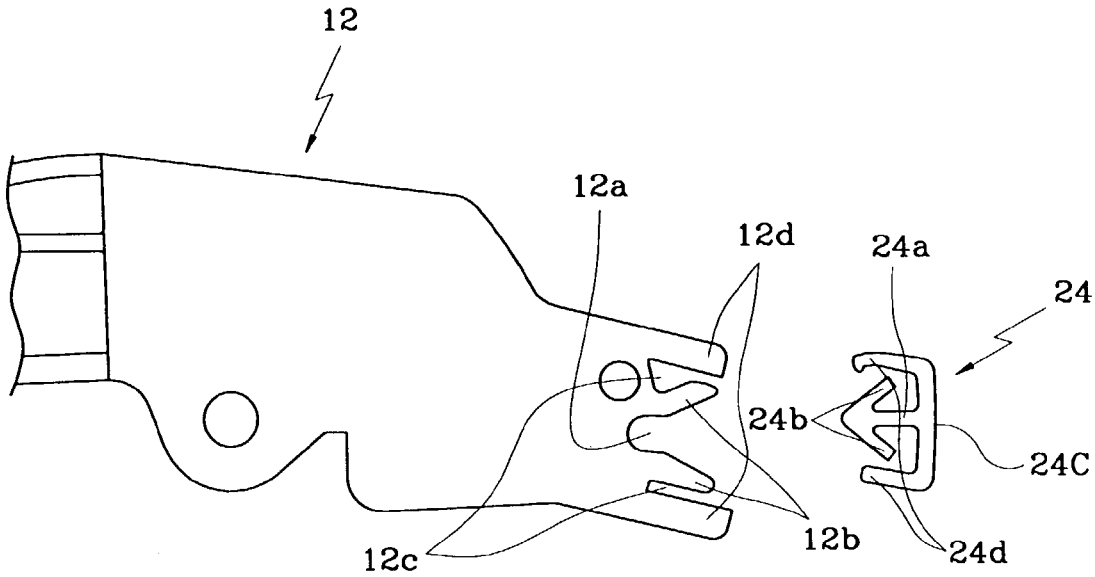
FIG. 3 illustrates an enlarged view of the coupling portion between the pedal arm and the foot pressure-adjusting means of FIG. 1.

As shown in FIG. 3, the foot pressure-adjusting means includes a friction plate 24 that is detachably coupled to the leading end of the pedal arm 12. The friction plate 24 includes an elastic installation part 24*a* having a pair of inclinedly spread protuberance parts 24*b* that couple to the leading end of the pedal arm 12 to maintain an elastic supporting force. A contact part 24*c* integrally extends from the elastic installation part 24*a* to contact the contact member 16. Also included is pair of securing support parts 24*d* that integrally extend from both ends of the contact part 24*c*. The pair of securing support parts 24*d* couple to the leading end of the pedal arm 12 and generate a securing strength.

The leading end of the pedal arm 12 has a mounting slot 12*a* for elastically receiving the friction plate 24. The mounting slot 12*a* receives the elastic installation part 24*a* of the friction plate 24. The mounting slot 12*a* is formed by a pair of elastic protuberances 12*b* which are inclinedly spread out to be contacted to the elastic installation part 24*a* of the friction plate 24. Furthermore, two auxiliary protuberance parts 12*d* are formed outside two auxiliary mounting slots 12*c* for receiving the securing and supporting parts 24*d* of the friction plate 24.

Figure 4:
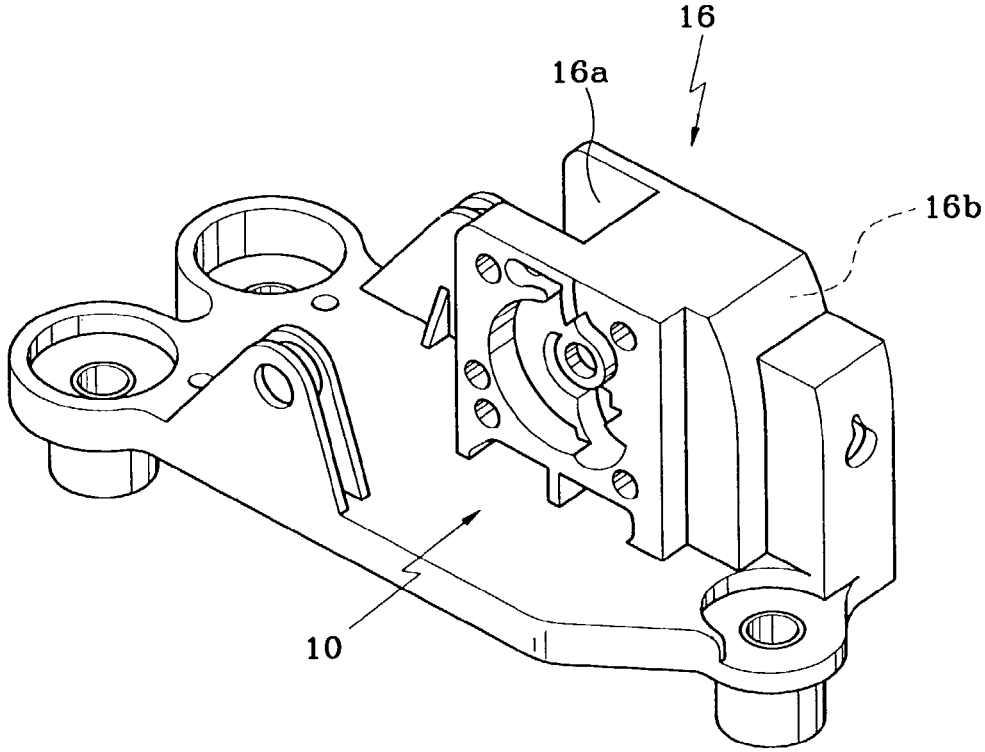
FIG. 4 is a perspective view of a contact member that accommodates and contacts the foot pressure-adjusting means of FIG. 1.
Figure 5:
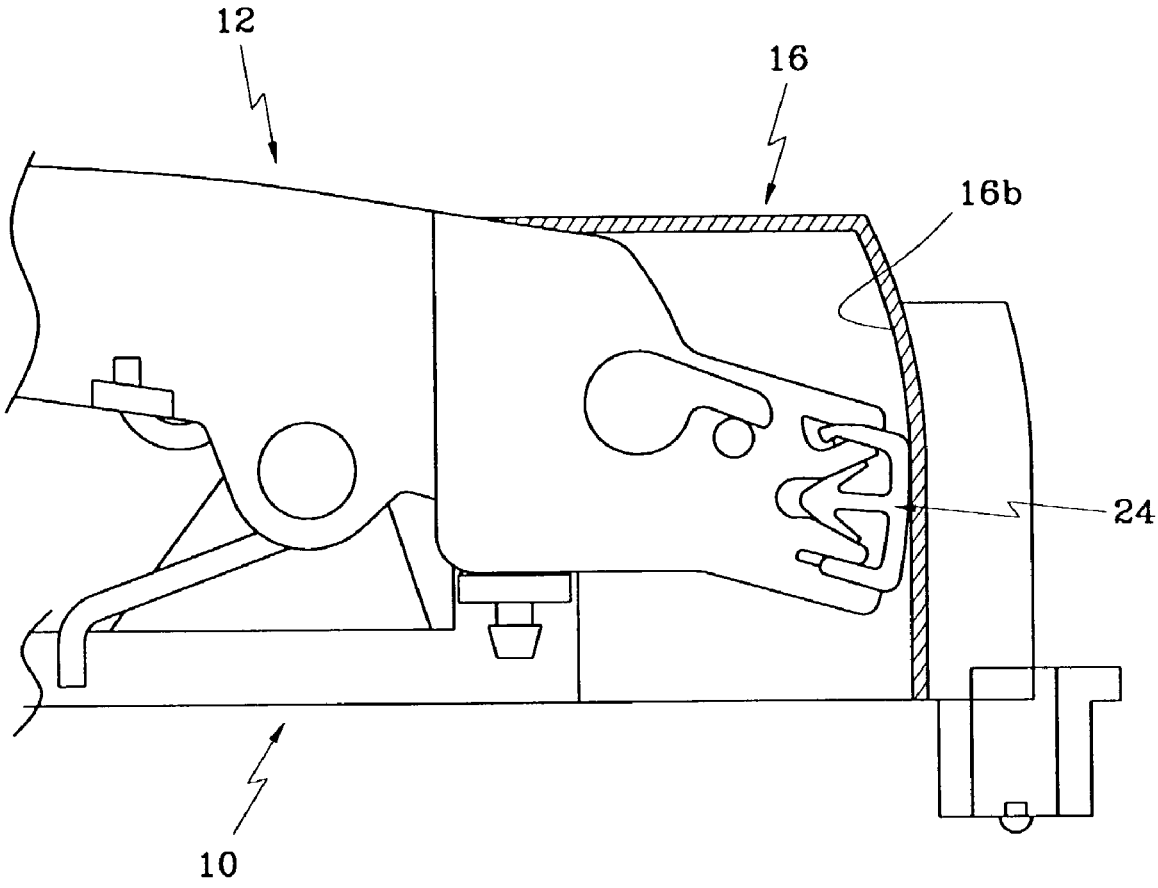
FIG. 5 illustrates the contact state between the foot pressure-adjusting means and the contact member during the depressing and releasing of the accelerator pedal.

As shown in FIGS. 4 and 5, the leading end of the pedal arm 12 is pivotally installed into the contact member 16 which projects upward on the housing 10. The contact member 16 includes a space of an opening part 16*a* that opens in the front and receives the leading end of the pedal arm 12. A contact face 16*b* is vertically formed for contacting the friction plate 24 that functions as the foot pressure-adjusting means. The friction plate 24, which is coupled to the leading end of the pedal arm 12, maintains contact with the contact face 16*b* of the contact member 16 during the pivoting of the pedal arm 12.

In use, if the driver depresses the pedal arm 12 during acceleration, the pedal arm 12 pivots around the fastening pin 18 upon the housing 10. Under this condition, the contact part 24*c* of the fiction plate 24 sustains contact with the contact face 16*b* of the contact member 16 and generates friction.

Figure 6:
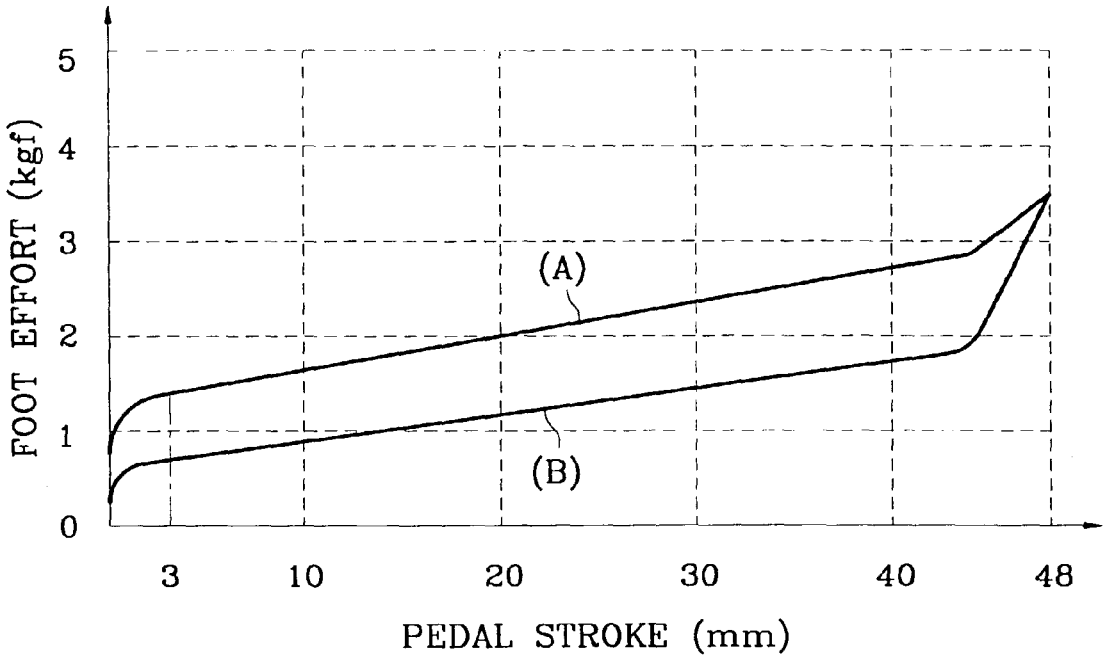
FIG. 6 is a graphical illustration showing the variation of the foot pressure with respect to the accelerator pedal stroke.

The degree of the driver's foot pressure that is transmitted to the pedal arm 12 varies depending on the direction of the friction force generated between the friction plate 24 and the contact member 16. That is, the degree of foot pressure required is variable depending on whether the driver is depressing the accelerator or releasing the accelerator, as graphically illustrated in FIG. 6. When the driver depresses the accelerator pedal, the variation of the foot pressure with respect to the stroke of the pedal arm 12 is equivalent to the sum of the inherent restoring force of the torsion spring 20 and the friction force generated between the friction plate 24 and the contact member 16. This is represented in graph A of FIG. 6.

If the driver releases the acceleration (this refers to the state where the driver releases the pedal arm to cause deceleration, or the driver maintains a constant velocity of the car), then the variation of the foot pressure is ascertained by the difference between the inherent elastic restoring force of the torsion springs 20 and the friction force (between the friction plate 24 and the contact member 16). This is represented in graph B of FIG. 6. That is, during a constant velocity, the direction of the friction force between the friction plate 24 and the contact member 16 is opposite to the direction of the elastic restoring force of the torsion spring 20. Therefore, if the driver desirers to maintain a constant car velocity, a foot pressure greater than the difference between the elastic restoring force of the torsion spring 20 and the friction force (between the friction plate 24 and the contact member 16) must be transmitted to the pedal arm 12.

Thus, during the depressing and releasing of the pedal arm, the reaction force which is received by the driver is different. Therefore, a foot pressure hysteresis can be formed, similar to the conventional mechanical cable-type accelerating system. Following adjustment to the elastic restoring force of the torsion spring 20 and the friction force between the friction plate 24 and the contact member 16, the foot pressure of the acceleration system can be set as desired.

The mounting slots 12*a* and the elastic protuberance part 12*b* together with the engaged elastic protuberance part 24*b* of the friction plate 24 forms an elastic restoring force which maintains contact between the friction plate 24 and the contact force 16*b* even following wear of the components. Therefore the foot pressure hysteresis is maintained. If grease or another lubricant is applied between the contact part 24*c* of the friction plate 24 and the contact face 16*b* of the contact member 16, noise generated by this contact can be prevented during the depressing and releasing of the pedal arm 12.

Figure 7:
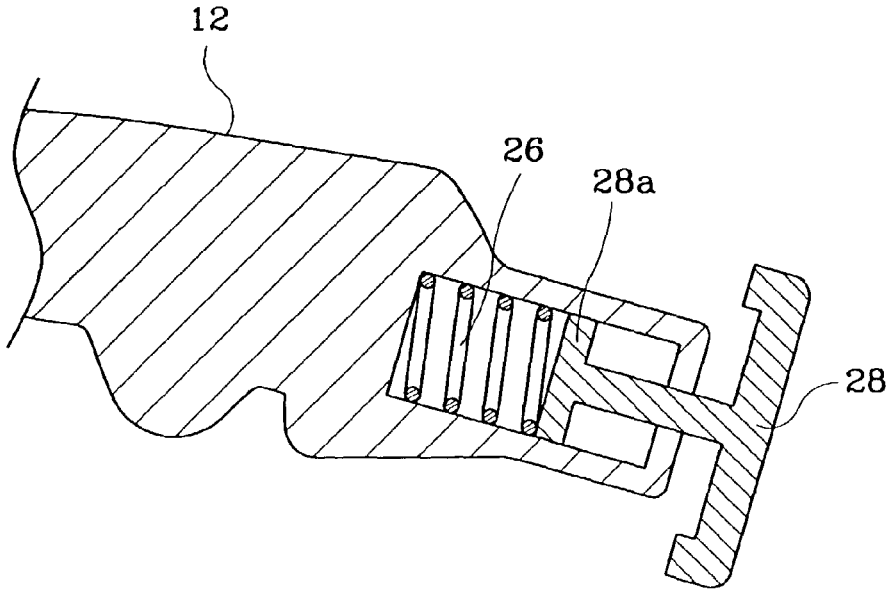
FIG. 7 illustrates another embodiment of the foot pressure-adjusting means according to the present invention.

FIG. 7 illustrates another embodiment of the foot pressure-adjusting means according to the present invention. The foot pressure-adjusting means includes a contact plate 28 with its rear face elastically supported to the leading end of the pedal arm 12 through a return spring 26. In this embodiment, the contact plate 28 is substituted for the friction plate 24 of the earlier embodiment. Furthermore, a closed space is formed in the leading end of the pedal arm 12 for accommodating the return spring 26. An engaging part 28*a* is provided on the rear face of the contact plate 28 for preventing the return spring 26 from departing from the closed space.

Figure 8:
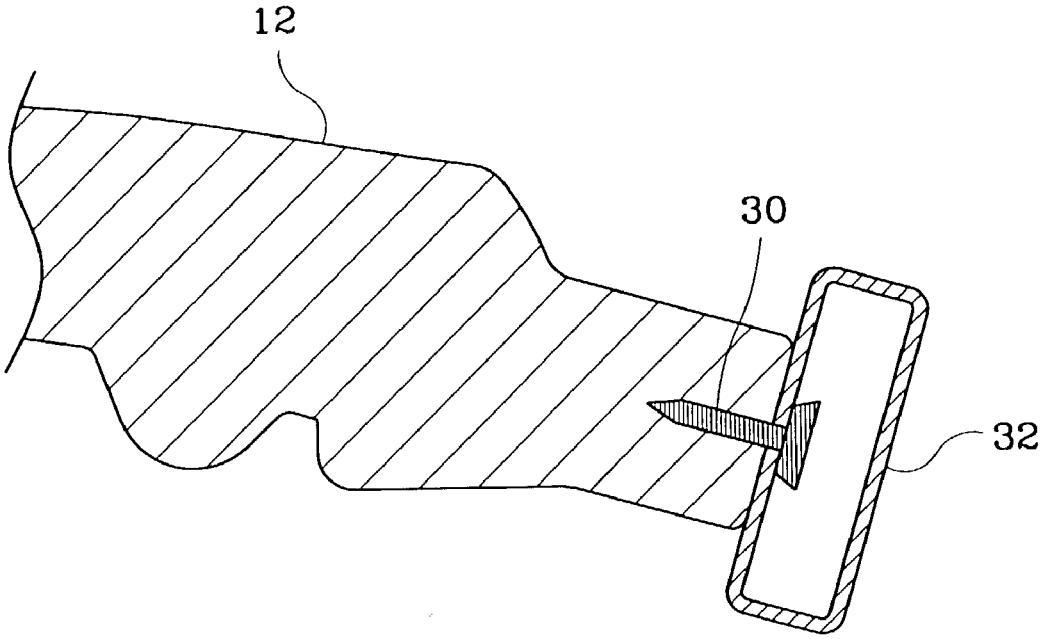
FIG. 8 illustrates still another embodiment of the foot pressure-adjusting means according to the present invention.

FIG. 8 illustrates still another embodiment of the foot pressure-adjusting means of the present invention. The foot pressure-adjusting means includes a hollow elastic plate 32 with its rear face secured to the leading end of the pedal arm 12 by means of a fastening pin 30. The front face faces toward the contact face 16*b* of the contact member 16. In this embodiment, the elastic plate 32 can be substituted for the friction plate 24 of the earlier embodiment.

Figure 9:
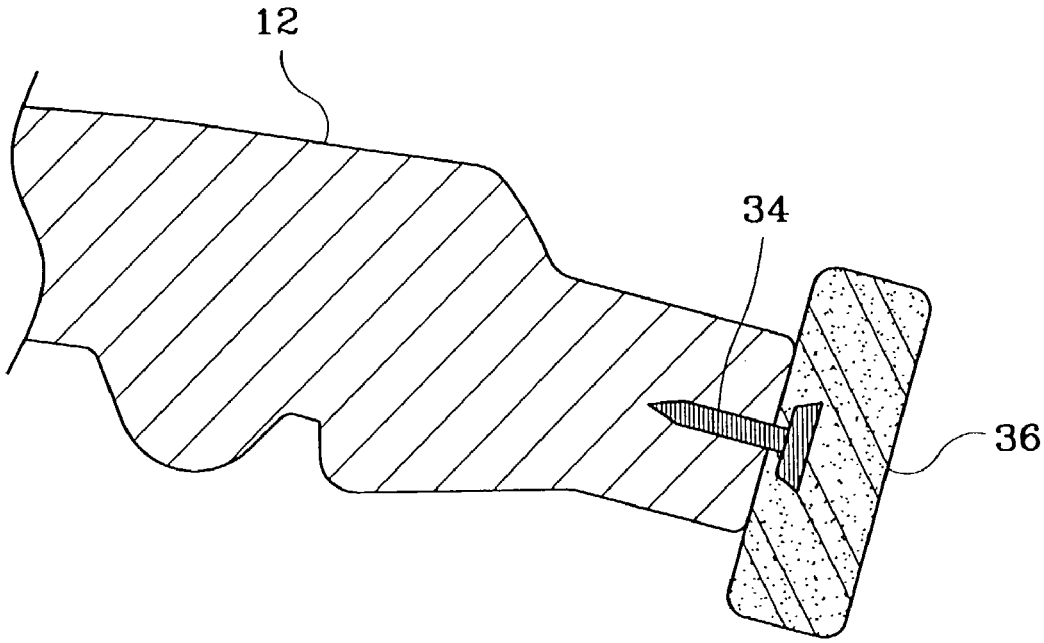
FIG. 9 illustrates yet another embodiment of the foot pressure-adjusting means according to the present invention.

FIG. 9 illustrates yet another embodiment of the foot pressure-adjusting means of the present invention. The foot pressure-adjusting means includes an elastic member 36 made of rubber, with its rear face secured to the leading end of the pedal arm 12 by means of a fastening pin 34. In this embodiment the elastic member 36 can be substituted for the friction plate 24 of the earlier embodiment of the present invention.

In the later described embodiments, the contact plate 28, the elastic plate 32 and the elastic member 36, which can be substituted for the friction plate 24 of the first embodiment, cause variations in the degree of foot pressure with respect to the stroke of the pedal arm 12 in the same manner as that of the earlier embodiment.

Many modifications and variations of the described embodiments will be apparent to one skilled in the art. The embodiments described in this application are intended for descriptive purposes and are not intended to limit the scope of the present invention. The scope of the present invention is defined by the appended claims, along with the full scope of equivalents to which such claims are entitled.

What is claimed is:

1. An electronic accelerator pedal system with a foot pressure-adjusting function, comprising:

a pedal arm pivotally installable within a car interior, said pedal arm comprising:

a mounting slot formed by two inclined elastic protuberance parts; and two auxiliary mounting slots formed by two auxiliary protuberance parts;

a detection sensor for detecting a pivoting degree of said pedal arm during a pivoting of said pedal arm;

a foot pressure-adjusting means installed on said pedal arm for causing a foot pressure to be varied in accordance with a pivoting direction of said pedal arm; and a contact member for contacting said foot pressure-adjusting means during the pivoting of said pedal arm;

wherein said foot pressure adjusting means comprises a friction plate, said friction plate comprising:

an elastic installation part with a pair of elastic protuberance parts formed thereon, and coupled to said pedal arm, wherein the mounting slot of the pedal arm furnishes an elastic supporting force to the elastic protuberance parts and accomodates the elastic installation part;

a contact part integrally extending from said elastic installation part for facially contacting said contact member; and a pair of securing and supporting parts extending from two leading ends of said contact part wherein the two auxiliary mounting slots of the pedal arm receive said pair of securing and supporting parts of said friction plate to provide a supporting and securing strength.

2. The electronic accelerator pedal system as claimed in claim 1, wherein said contact member comprises:

an opening part frontally open for receiving the leading end of said pedal arm; and a contact face for contacting said friction plate within said opening part.

* * * * *